US008919525B2

(12) United States Patent
Liu et al.

(10) Patent No.: US 8,919,525 B2
(45) Date of Patent: Dec. 30, 2014

(54) GATE MECHANISM

(75) Inventors: Dongbo Liu, Guangzhou (CN); Shaohai Huang, Guangzhou (CN)

(73) Assignee: GRG Banking Equipment Co., Ltd., Guangzhou (CN)

( * ) Notice: Subject to any disclaimer, the term of this patent is extended or adjusted under 35 U.S.C. 154(b) by 0 days.

(21) Appl. No.: 13/882,990

(22) PCT Filed: Jul. 9, 2012

(86) PCT No.: PCT/CN2012/078351

§ 371 (c)(1), (2), (4) Date: May 2, 2013

(87) PCT Pub. No.: WO2013/023503

PCT Pub. Date: Feb. 21, 2013

(65) Prior Publication Data

US 2014/0216890 A1 Aug. 7, 2014

(30) Foreign Application Priority Data

Aug. 17, 2011 (CN) ..... 2011 1 0235749

(51) Int. Cl.

| | |
|---|---|
| ***G07F 1/00*** | (2006.01) |
| ***E05D 15/36*** | (2006.01) |
| ***G07D 11/00*** | (2006.01) |
| ***G07F 19/00*** | (2006.01) |

(52) U.S. Cl.

CPC ..... *G07D 11/0018* (2013.01); *G07F 19/205* (2013.01); *G07D 11/0003* (2013.01)

USPC ..... 194/351; 194/201; 49/201; 109/70; 232/44

(58) Field of Classification Search

CPC ..... E06B 3/50; E06B 3/5018; G07D 11/003; G07D 11/0018; G07D 11/0093; G07F 19/00

USPC ..... 194/351; 49/146, 197, 199, 201; 312/350; 109/64, 66, 69, 70; 232/44

See application file for complete search history.

(56) References Cited

U.S. PATENT DOCUMENTS

| | | | | |
|---|---|---|---|---|
| 2,590,028 A * | 3/1952 | Miller | ..... | 312/323 |
| 4,466,357 A | 8/1984 | Masachika | | |
| 5,172,643 A * | 12/1992 | Koshida et al. | ..... | 109/10 |

FOREIGN PATENT DOCUMENTS

| | | |
|---|---|---|
| CN | 2362160 Y | 2/2000 |
| CN | 1450501 A | 10/2003 |

(Continued)

*Primary Examiner* — Mark Beauchaine

(74) *Attorney, Agent, or Firm* — Kilpatrick Townsend & Stockton LLP

(57) ABSTRACT

Disclosed is a gate mechanism (100) mounted on a side frame (210) of a financial automated machine cash slot (230*a*), wherein the gate mechanism comprises a gate (10), a driving mechanism (20) and a pair of locking mechanisms (30) controlling the gate (10), with the lower end of the gate (10) being connected with a front end (240*a*) of the frame side (240) in such a way as to be able to slide up and down, and the upper end of the gate (10) being connected with an upper end (240*b*) of the frame side (240) in such a way as to be able to slide back and forth, and the driving mechanism (20) driving the upper end of the gate (10) in sliding back and forth at the upper end (240*b*) of the frame side (240), while causing the lower end of the gate (10) to move up and down at the front end (240*a*) of the frame side (240), thus achieving opening and closing of the gate (10). The gate mechanism (100) can reduce the motion enveloping space of the gate (10) and has the advantage of a compact structure.

8 Claims, 6 Drawing Sheets

(56) References Cited

FOREIGN PATENT DOCUMENTS

| | | | |
|---|---|---|---|
| CN | 101030308 | A | 9/2007 |
| CN | 101684713 | A | 3/2010 |
| CN | 101840596 | A | 9/2010 |
| CN | 102289862 | A | 12/2011 |
| GB | 2177530 | A | 1/1987 |
| JP | 58204287 | A | 11/1983 |

* cited by examiner

GATE MECHANISM

The present application is the national phase of International Application No. PCT/CN2012/078351, titled "SHUTTER MECHANISM", filed on Jul. 9, 2012, which claims the priority of Chinese Patent Application No. 201110235749.0 titled "SHUTTER MECHANISM", filed with the Chinese Patent Office on Aug. 17, 2011, the entire disclosure of which is incorporated herein by reference.

FIELD OF THE INVENTION

The present application relates to a shutter mechanism of a financial self-service device, and in particular to a shutter mechanism having a compact structure.

BACKGROUND OF THE INVENTION

The financial self-service device has been widely used in everyday life, and can provide 24-hour continuous service and bring significant convenience for customers. However, for the unattended automated teller machine, there exists a risk that the money of is the depositor may be stolen or intercepted by criminals. Therefore, the application security of the financial self-service device is causing more and more attention. For providing a violence-preventing protection for the financial self-service device, there are several structural embodiments which can realize the function of a shutter of the financial self-service device, such as opening, closing and locking function.

The shutter structure of some commercially available financial self-service devices mainly has two action principles, that is, a sliding manner, in which the shutter is placed horizontally or tilted at a certain degree, and a pivoting manner. One solution uses a principle of the shutter mechanism sliding back and forth in a certain plane. For example, as disclosed in a patent application No. 200910041871.7 titled "A safe shutter device and an automated teller machine having the same" with the publication No. CN101684713A, two planar sliding grooves are respectively provided at two sides of the shutter of the safe shutter device, the shutter mechanism is driven by a force to slide back and forth along a fixed sliding groove, and two extreme positions of the planar sliding groove respectively correspond to an open state and a close state of the shutter mechanism. The major problem of such shutter mechanism is that, because the mounting space is relatively large due to the alternative open and close states, the shutter mechanism is generally adapted to be placed horizontally or tilted.

In another solution, the shutter mechanism rotates around an axis to realize the open and close actions. For example, in the automatic shutter device disclosed in the patent application No. 200910193709.7 with the publication No. CN101840596A, one end of the shutter of the device is fixed on a rotating axis, and the shutter is driven by a force to rotate around the axis by a certain angle from an initial angle, such that the shutter is in close and open states respectively. The major problem of such shutter mechanism is that, the enveloping space of the spatial motion is relatively large due to the motion manner, thus enough space is required for realizing the action of the shutter, and if there is a requirement on the space limitation, the application of such shutter mechanism is not convenient. A shutter mechanism on the product LOBBY90 of Wincor Company, which also rotates around an axis, solves the problem of the large motion enveloping space, however the arc shutter plate causes a lot of inconveniences during the overall mounting and fitting process.

Further, for some through-the-all or outdoor placed financial self-service devices, the transaction interface is generally exposed, which requires the shutter having a certain rainproof function.

Therefore, it is urgent to provide a shutter mechanism which is able to reduce the enveloping space of the motion of the shutter and has a compact structure.

SUMMARY OF THE INVENTION

The object of the present application is to provide a shutter mechanism which is able to reduce the enveloping space of the motion of the shutter and has a compact structure, For realizing the above object, the present application provides a shutter mechanism mounted on a lateral frame of a banknote port of a financial self-service device. The shutter mechanism includes a shutter, a driving mechanism, and a locking mechanism for controlling the shutter. A lower end of the shutter is slidably connected to a front end of a lateral surface of the frame in an up-down direction, an upper end of the shutter is slidably connected to an upper end of the lateral surface of the frame in a front-back direction, and the upper end of the shutter is driven by the driving mechanism to slide along the upper end of the lateral surface of the frame front and back, which meanwhile drives the lower end of the shutter to move along the front end of the lateral surface of the frame up and down, thereby realizing the opening and closing of the shutter.

Preferably, a first sliding groove is provided at the front end of the lateral surface of the frame in an up-down direction, a second sliding groove is provided at the upper end of the lateral surface of the frame in a front-back direction, a first sliding portion extending from the lower end of the shutter cooperates with the first sliding groove, and a second sliding portion extending from the upper end of the shutter cooperates with the second sliding groove. Due to the cooperating between the first sliding groove and the first sliding portion and the cooperating between the second sliding groove and the second sliding portion, the sliding and turning motion of the shutter is more reliable, when the lower end of the shutter slides along the front end of the lateral surface of the frame up and down and the upper end of the shutter slides along the upper end of the lateral surface of the frame front and back.

Specifically, the first sliding groove includes a straight portion and an arc portion, the arc portion is curved in a direction away from the banknote port and is provided adjacent to the second sliding groove, and the second sliding groove is a straight groove, such that the enveloping space generated by the shutter when opening or closing the banknote port is smaller, thereby further creating a better condition for simplifying the structure of the shutter mechanism of the present application.

Two first sliding portions are provided at two sides of the lower end of the shutter respectively, two second sliding portions are provided at two sides of the upper end of the shutter respectively, the first sliding portions and the second sliding portions are cylindrical, and the cylindrical first sliding portions and second sliding portions each are pivotally connected with a roller wheel. Due to the two first sliding portions provided at two sides and the two second sliding portions provided at two sides, the stress at various positions of the shutter is more even, thereby improving the accuracy and the reliability of the shutter when opening or closing the banknote port. Due to the roller wheel, the sliding of the shutter is more flexible and has smaller resisting force, such that the driving mechanism may more easily drive the shutter to open or close the banknote port.

Preferably, the driving mechanism includes a conveying member and a driving assembly, the conveying member is provided at the upper end of the lateral surface of the frame in a front-back direction, an output end of the driving assembly is connected to the conveying member, and the second sliding portion is fixed on the conveying member, such that via the conveying member and the second sliding portion, the driving assembly may more easily drive the shutter to open or close the banknote port. Specifically, the driving mechanism further includes a second position sensor electrically connected to a controller of the financial self-service device, and a locking assembly. The second sliding portion is fixed on one end of the locking assembly, and the other end of the locking assembly is fixed on the conveying member. Two second position sensors are respectively provided at the upper end of the lateral surface of the frame in a front-back direction and are located outside two sides of the locking assembly respectively. A position of the locking assembly corresponds to one of the second position sensors when the shutter closes the banknote port, and the position of the locking assembly corresponds to the other one of the second position sensors when the shutter opens the banknote port, such that via the driving mechanism, the controller can accurately control the shutter to open or close the banknote port.

More specifically, the driving assembly includes a motor, a driving gear, a driven gear, a driving shaft, a primary driving wheel and an auxiliary driving wheel. The driving shaft is pivotally connected to a rear of the upper end of the lateral surface of the frame, and protrudes out of the upper end of the lateral surface of the frame to form a mounting end. The primary driving wheel is mounted on the mounting end, and the auxiliary driving wheel is pivotally connected to a front of the upper end of the lateral surface of the frame at a position corresponding to the primary driving wheel. The conveying member is surroundingly provided at outside of the primary driving wheel and the auxiliary driving wheel, the motor is mounted on the frame, the driving gear is mounted on an output shaft of the motor, the driven gear is mounted on the driving shaft and is engaged with the driving gear, and a torque limiter is provided between the driving shaft and the driven gear. The above configuration may simplify the structure of the driving assembly, facilitate the dismounting and the maintenance, and further miniaturize the shutter mechanism of the present application on one hand; and avoid an excessive clamping force when the closing is overloaded, and prevent components from being impacted repeatedly when the opening is overloaded on the other hand, thereby ensuring the shutter mechanism of the present application working more reliably.

Preferably, the locking mechanism includes a locking and driving assembly electrically connected to the controller, and a locking plate located above the banknote port and pivotally connected to the frame. The locking and driving assembly drives the locking plate to abut against and lock the shutter when the shutter closes the banknote port, such that when closing the banknote port, the shutter is in a locked state, thereby preventing violent pry or damaging force action to some extent and ensuring the security of the banknote inside the financial self-service device and the security of corresponding components of the shutter mechanism of the present application. Specifically, the locking mechanism further includes a first position sensor electrically connected to the controller and provided at the upper end of the lateral surface of the frame. One end of the locking plate is extended toward the banknote port to form a locking portion, and the other end of the locking plate is extended toward the first position sensor to form a sensing portion. A position of the sensing portion corresponds to the first position sensor, when the shutter closes the banknote port and the locking portion abuts against and locks the shutter. Due to the first position sensor, the controller can accurately control the locking mechanism to lock or loosen the shutter. Since the locking portion abuts and locks the shutter, a stress direction of the shutter is reasonable, thereby further ensuring the security of the banknote inside the financial self-service device and the security of corresponding structures of the shutter mechanism of the present application. More specifically, two locking portions are provided at two sides of the locking plate respectively, such that the locking force at various positions of the shutter is more even, thereby further increasing the locking force and meanwhile avoiding the deformation of the shutter caused by uneven stress.

Compared to the prior art, the lower end of the shutter of the present application is slidably connected to the front end of the lateral surface of the frame in an up-down direction, the upper end of the shutter is slidably connected to the upper end of the lateral surface of the frame in a front-back direction, and the upper end of the shutter is driven by the driving mechanism to slide along the upper end of the lateral surface of the frame front and back, and meanwhile the lower end of the shutter is driven to slide along the front end of the lateral surface of the frame up and down, such that the shutter is driven by the driving mechanism to make rigid planar motion (i.e. combining the existing sliding manner, sliding back and forth in a certain plane, and pivoting manner of the shutter), which overcomes the disadvantage of the existing sliding shutter mechanism or the pivoting shutter mechanism that the space occupied by the shutter mechanism is relatively large due to the extremely huge enveloping space generated by the motion of the shutter. Therefore, the shutter mechanism of the present application can reduce the enveloping space generated by the motion of the shutter and can also reduce the space of the frame occupied by the shutter, such that the structure of the shutter mechanism of the present application is more compact.

DETAILED DESCRIPTION OF THE INVENTION

For illustrating technical contents and structural features of the present application in detail, the present application is further described below in conjunction with embodiments and drawings.

Figure 1:
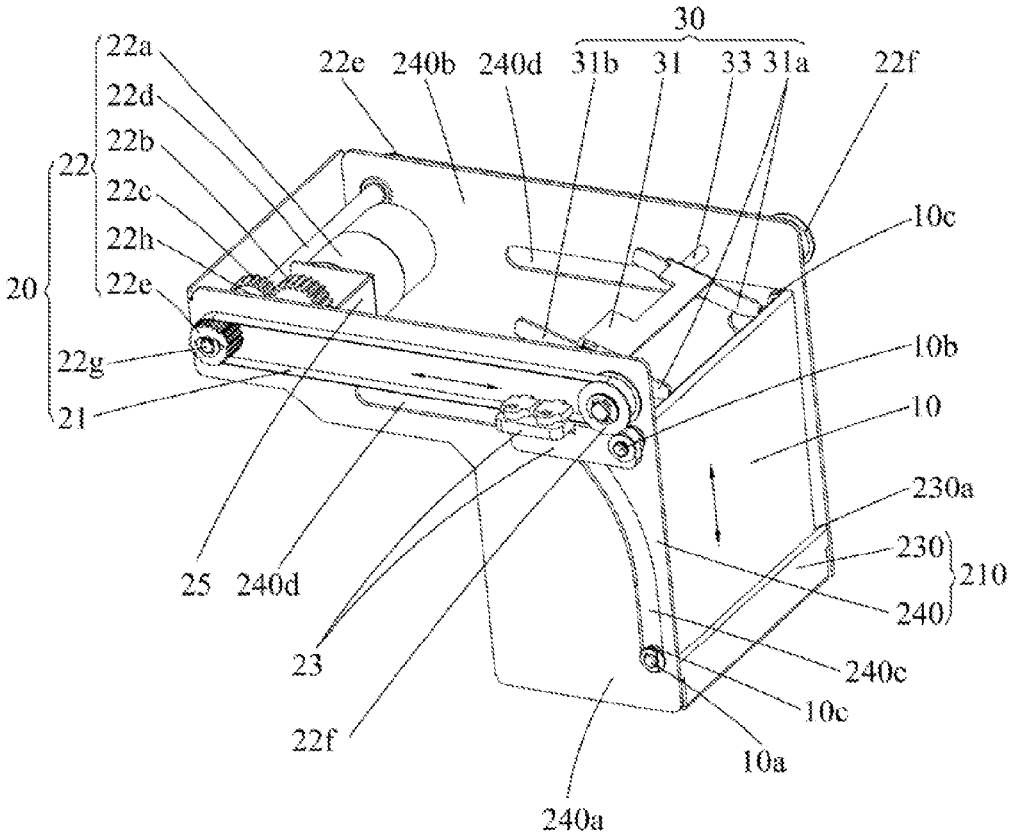
FIG. 1 is a perspective view of a shutter mechanism of the present application.

Referring to FIG. 1, a shutter mechanism 100 of the present application is mounted on a lateral frame 210 of a banknote port 230*a* of a financial automatic device and is electrically connected to a controller (not shown) of the device, and the banknote port 230*a* is provided on a front face 230 of the frame 210. The shutter mechanism 100 of the present application includes a shutter 10, a driving mechanism 20, and a locking mechanism 30 for controlling the shutter 110. The driving mechanism 20 and the locking mechanisms 30 are provided on the frame 210. Meanwhile, a lower end of the shutter 10 is slidably connected to a front end 240*a* of a lateral surface 240 of the frame in an up-down direction (i.e. a direction indicated by an arrow on the shutter 10 in FIG. 1), and an upper end of the shutter 10 is slidably connected to an upper end 240*b* of the lateral surface 240 of the frame in a front-back direction (i.e. a direction indicated by an arrow on the lateral surface 240 of the frame in FIG. 1). The driving mechanism 20 drives the upper end of the shutter 10 to slide backward along the upper end 240*b* of the lateral surface 240 of the frame, and meanwhile drives the lower end of the shutter 10 to slide upward along the front end 240*a* of the lateral surface 240 of the frame, then the shutter 10 opens the banknote port 230*a;* the driving mechanism 20 drives the upper end of the shutter 10 to slide forward along the upper end 240*b* of the lateral surface 240 of the frame, and meanwhile drives the lower end of the shutter 10 to move downward along the front end 240*a* of the lateral surface 240 of the frame, then the shutter 10 closes the banknote port 230*a*, and then the locking mechanism 30 locks the shutter 10 closing the banknote port 230*a*.

Specifically, referring to FIGS. 1, 3, 4*a* and 4*b*, a first sliding groove 240*c* is provided at the front end 240*a* of the lateral surface 240 of the frame in an up-down direction, a second sliding groove 240*d* is provided at the upper end 240*b* of the lateral surface 240 of the frame in a front-back direction, a first sliding portion 10*a* extending from the lower end of the shutter 10 cooperates with the first sliding groove 240*c*, and a second sliding portion 10*b* extending from the upper end of the shutter 10 cooperates with the second sliding groove 240*d*. Due to the cooperating between the first sliding groove 240*c* and the first sliding portion 10*a* and the cooperating between the second sliding groove 240*d* and the second sliding portion 10*b*, the sliding and turning motion of the shutter 10 is more reliable, when the lower end of the shutter 10 slides along the front end 240*a* of the lateral surface 240 of the frame up and down and the upper end of the shutter 10 slides along the upper end 240*b* of the lateral surface 240 of the frame front and back. For further reducing the enveloping space generated by the shutter 10 when opening or closing the banknote port 230*a*. so as to further create a better condition for simplifying the structure of the shutter mechanism 100 of the application, the first sliding groove 240*c* includes a straight portion and an arc portion, the arc portion is curved in a direction away from the banknote port 230*a* and is provided adjacent to the second sliding groove 240*d*, and the second sliding groove 240*d* is a straight groove. For further miniaturizing the shutter mechanism 100 of the present application and facilitating the motion of the shutter 10, in this embodiment, two first sliding grooves 240*c* are provided symmetrically on two sides of the front end 240*a* of the lateral surface 240 of the frame respectively, and two second sliding grooves 240*d* are provided symmetrically on two sides of the upper end 240*b* of the lateral surface 240 of the frame respectively. In order that the stress at various positions of the shutter 10 is more even so as to improve the accuracy and the reliability of the shutter 10 when opening or closing the banknote port 230*a*, two first sliding portions 10*a* are provided on two sides of the lower end of the shutter 10 respectively, and two second sliding portions 10*b* are provided on two sides of the upper end of the shutter 10 respectively. In order that the sliding of the shutter 10 is more flexible and has smaller resisting force so as to make it easier for the driving mechanism 20 to drive the shutter 10 to open or close the banknote port 230*a*, the first sliding portions 10*a* and the second sliding portions 10*b* are cylindrical, and the cylindrical first sliding portions 10*a* and second sliding portions 10*b* each are pivotally connected with a roller wheel 10*c*.

Referring to FIGS. 1 to 4*b*, the driving mechanism 20 includes a conveying member 21, a driving assembly 22, a locking assembly 23, and a second position sensor 24 electrically connected to the controller. The conveying member 21 is provided at the upper end 240*b* of the lateral surface 240 of the frame in a front-back direction, an output end of the driving assembly 22 is connected to the conveying member 21, and the second sliding portion 10*b* is fixed on the conveying member 21. In this embodiment, the second sliding portion 10*b* is fixed on the conveying member 21 by the locking assembly 23, such that the driving assembly 22 may more easily drive the shutter 10 to open or close the banknote port 230 via the conveying member 21 and the second sliding portion 10*b;* and the locking assembly 23 fixedly connected to the second sliding portion 10*b* is fixed to the conveying member 21. Second position sensors 24 are respectively provided at the upper end 240*b* of the lateral surface 240 of the frame in a front-back direction and are located outside two sides of the locking assembly 23 respectively. When the shutter 10 closes the banknote port 230*a*, a position of the locking assembly 23 corresponds to one of the second position sensors 24 (i.e. a detecting sheet 23*a* of the locking assembly 23 is within a detecting region of the above second position sensor 24), and when the shutter 10 opens the banknote port 230*a*, the position of the locking assembly 23 corresponds to the other one of the second position sensors 24 (i.e. the detecting sheet 23*a* of the locking assembly 23 is within the detecting region of the above second position sensor 24), such that the controller may accurately control the shutter 10 to open or close the banknote port 230*a* via the driving mechanism 20.

More specifically, the driving assembly 22 includes a motor 22*a*, a driving gear 22*b,* a driven gear 22*c*, a driving shaft 22*d*, a primary driving wheel 22*e*, an auxiliary driving wheel 22*f* and a torque limiter 22*h*. The driving shaft 22*d* is pivotally connected to a rear of the upper end 240*b* of the lateral surface 240 of the frame and protrudes out of the upper end 240*b* of the lateral surface 240 of the frame to form a mounting end 22*g*. The primary driving wheel 22*e* is mounted on the mounting end 22*g*, the auxiliary driving wheel 22*f* is pivotally connected to a front of the upper end 240*b* of the lateral surface 240 of the frame, and the conveying member 21 is surroundingly provided at outside of the primary driving wheel 22*e* and the auxiliary driving wheel 22*f*. The motor 22*a* is mounted on the upper end 240*b* of the lateral surface 240 of the frame via a mounting bracket 25 and is located between two lateral surfaces 240 of the frame, such that the structure of the frame 210 is more compact. The driving gear 22*b* is mounted on an output shaft of the motor 22*a*, the driven gear 22*c* is mounted on the driving shaft 22*d* and is engaged with the driving gear 22*b*, and the torque limiter 22*h* is located between the driving shaft 22*d* and the driven gear 22*c*.

In this embodiment, two ends of the driving shaft 22*d* protrude out of the upper ends 240*b* of the two lateral surfaces 240 of the frame respectively to form two mounting ends 22*g*. Each mounting end 22*g* is mounted with a primary driving wheel 22*e*, correspondingly, there are two auxiliary driving wheels 22*f* corresponding to the two (primary driving wheels 22*e* respectively; there are two conveying members 21, each of which is surroundingly provided at outside of one of the primary driving wheels 22*e* and one of the auxiliary driving wheels 22*f;* there are two locking assemblies 23, each of which is fixed on one of the conveying members 21 and is fixedly connected to one of the second sliding portions 10*b* of the shutter 10; and the number of the second position sensors 24 may remain unchanged, since the second position sensors 24 are only need to be mounted on either of the upper ends 240*b* of the two lateral surfaces 240 of the frame. An object of such design is to realize the both-side synchronous driving of the shutter 10 by the driving assembly 22. Certainly, one end of the driving shaft 22*d* protrudes out of the upper end 240*b* of one lateral surface 240 of the frame to form one mounting end 22*g*, one primary driving wheel 22*e* is mounted on the mounting end 22*g*, one auxiliary driving wheel 22*f* is provided to correspond to the primary driving wheel 22*e*, one conveying member 21 is surroundingly provided at outside of the primary driving wheel 22*e* and the auxiliary driving wheel 22*f*, one locking assembly 23 is fixed on the conveying member 21 and is fixedly connected to one second sliding portion 10*b* of the shutter 10, due to the cooperating of the above components, an object of single-side driving of the shutter 10 by the driving assembly 22 can also be realized. Due to fact that the driving assembly 22 is composed of the motor 22*a*, the driving gear 22*b*, the driven gear 22*c*, the driving shaft 22*d*, the primary driving wheel 22*e*, the auxiliary driving wheel 22*f* and the torque limiter 22*h*, the structure of the driving assembly 22 is simple and the dismounting and the maintenance are convenient, thereby further miniaturizing the shutter mechanism 100 of the present application. Due to the torque limiter 22*h*, an excessive clamping force when the closing is overloaded is avoided, components being impacted repeatedly when the opening is overloaded is also prevented, thereby ensuring the shutter mechanism 100 of the present application working more reliably. The conveying member 21 may be a conveying belt or a conveying chain, such that the structure of the conveying member 21 is simple and practical.

Referring to FIGS. 1 to 4*b* again, the locking mechanism 30 includes a locking and driving assembly (not shown) electrically connected to the controller, and a locking plate 31 located above the banknote port 230*a* and pivotally connected to the frame 210 via a rotating shaft 33. The locking and driving assembly drives the locking plate 31 to abut against and lock the shutter 10 when the shutter 10 closes the banknote port 230*a*, such that when closing the banknote port 230*a*, the shutter 10 is in a locked state, thereby preventing violent pry or damaging force action to some extent and ensuring the security of the banknote inside the financial self-service device and the security of the corresponding components of the shutter mechanism 100 of the present application. in this embodiment, the locking mechanism 30 further includes a first position sensor 32 electrically connected to the controller and provided at the upper end 240*b* of the lateral surface 240 of the frame. One end of the locking plate 31 is extended toward the banknote port 230*a* to form a locking portion 31*a*, the other end of the locking plate 31 is extended toward the first position sensor 32 to form a sensing portion 31*b*, and a position of the sensing portion 31*b* corresponds to the first position sensor 32 (i.e. the sensing portion 31*b* is within a detecting region of the first position sensor 32), when the shutter 10 closes the banknote port 230*a* and the locking portion 31*a* abuts against and locks the shutter 10. Due to the first position sensor 32, the controller can accurately control the locking mechanism 30 to lock or loosen the shutter 10. Since the locking portion 31*a* abuts and locks the shutter 10, the stress direction of the shutter 10 is reasonable, thereby further ensuring the security of the banknote inside the financial self-service device and the security of the corresponding structures of the shutter mechanism 100 of the present application. Two locking portions 31*a* are provided at two sides of the locking plate 31 respectively, such that the locking force at various positions of the shutter 10 is more even, thereby further increasing the locking force and meanwhile avoiding the deformation of the shutter caused by uneven stress.

Figure 2:
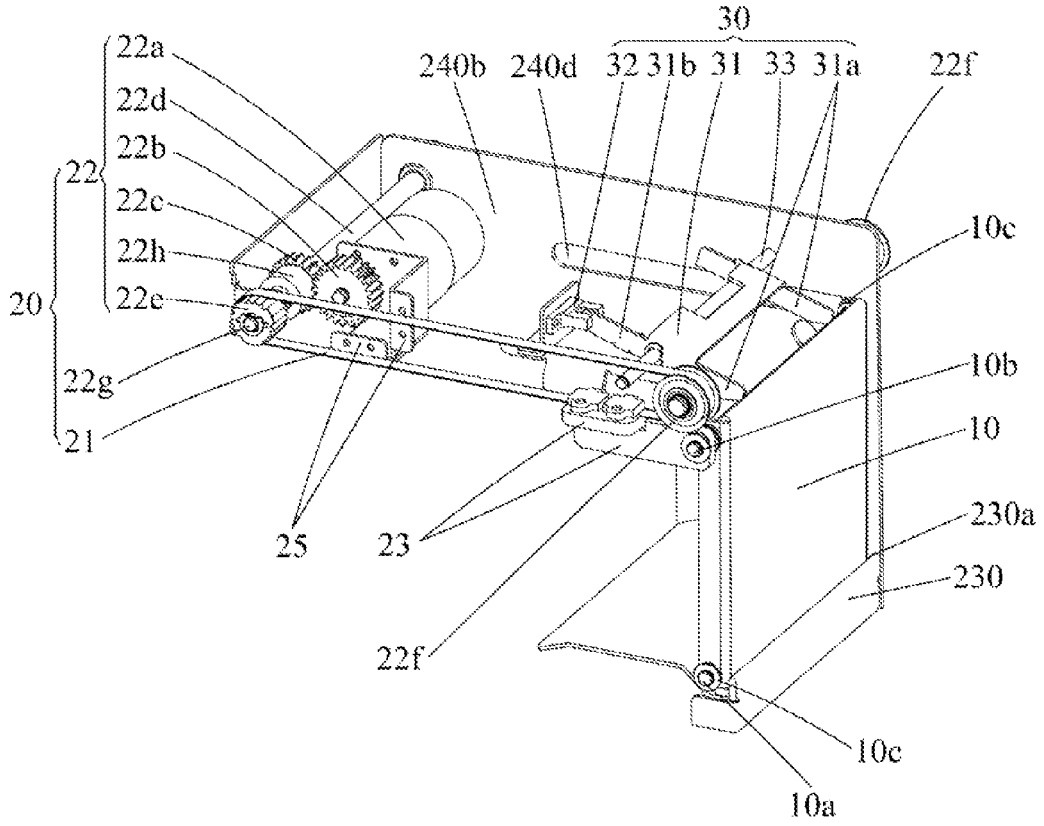
FIG. 2 is a structural schematic view of the shutter mechanism shown in FIG. 1, in which a lateral surface of a frame is removed.
Figure 3:
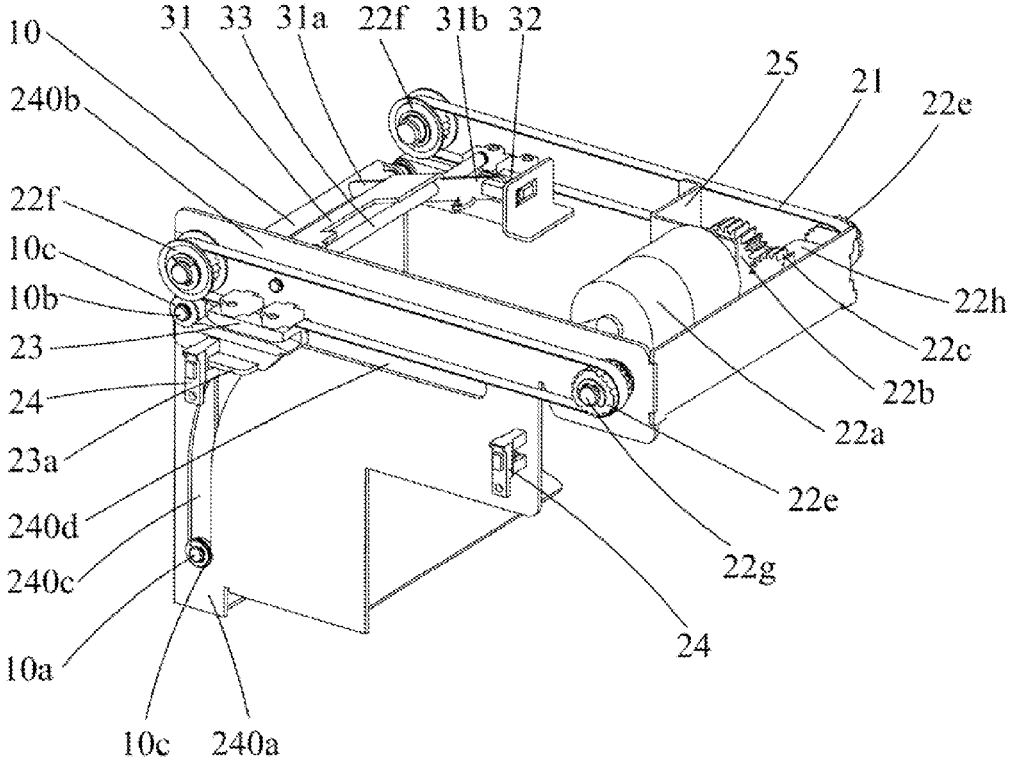
FIG. 3 is a structural schematic view of FIG. 2 viewed from another angle.

In conjunction with the drawings, the process of the opening and closing actions of the shutter of the shutter mechanism of the present application is described as follows. In a normal state, under the action of the locking and driving assembly, the locking plate 31 of the locking mechanism 30 is in a reset state as shown in FIG. 2, in this state the sensing portion 31*b* of the locking plate 31 blocks a detecting signal of the first position sensor 32, and the locking portion 31*a* of the locking plate 31 abuts against the upper end of the shutter 10 to lock the shutter 10, such that the shutter 10 can not move, and the shutter 10, that can not move, closes the banknote port 230*a*. When needs to open the banknote port 230*a* by the shutter 10, the controller sends a driving or controlling signal, the locking plate 31 is driven by the locking and driving assembly to rotate around the rotating shaft 33 (i.e. rotate in an anticlockwise direction in FIG. 2), such that the locking portion 31*a* of the locking plate 31 is lifted to avoid the enveloping space of the motion of the shutter 10. At this time the sensing portion 31*b* of the locking plate 31 deviates from the detecting region of the first position sensor 32, and the controller receives an unblocked detecting signal from the first position sensor 32, which indicates that the opening action of the locking plate 31 of the locking mechanism 30 is completed; then the controller sends a driving or controlling signal to start the motor 22*a*, the driving gear 22*b* engages with the driven gear 22*c* to transmit power to the torque limiter 22*h*, the driving shaft 22*d* is driven by the torque limiter 22*h* to rotate, and the primary driving wheel 22*e*, the auxiliary driving wheel 22*f* and the conveying belt 21 cooperate to transmit the power to the locking assembly 23, then the locking assembly 23 transmits the power to the second sliding portions 10*b* at two sides of the shutter 10, such that the upper end of the shutter 10 is driven by the second sliding portions 10*b* to move along the second sliding groove 240*d*, and meanwhile the lower end of the shutter 10 moves along the first sliding groove 240*c*. Due to the limitation of the first sliding groove 240*c* and the second sliding groove 240*d*, the second sliding portion 10*b* of the shutter 10 slides leftward in FIG. 4 along the second sliding groove 240*d*, meanwhile the first sliding portion 10*a* of the shutter 10 slides upward in FIG. 4 along the first sliding groove 240*c*, such that the shutter 10 may make a rigid planar motion combining the sliding and rotating motions, When one of the second position sensors 24, corresponding to a state that the shutter 10 is opened in place, detects that the detecting sheet 23*a* of the locking assembly 23 is in place (as shown in FIGS. 2 and 3), the shutter 10 is opened in place, corresponding to a state shown in FIG. 4*a*, and completes the action of opening the banknote port 230*a*. At this time, the controller sends a driving or controlling signal to the locking and driving assembly, the locking and driving assembly drives the locking plate 31 to rotate around the rotating shaft 33 to return to the original position, and when the locking plate 31 rotates back to a specific position, the sensing portion 31*b* blocks the detecting signal of the first position sensor 32, then the first position sensor 32 sends a detecting signal to the controller to be analyzed, such that the controller determines that the locking plate 31 is returned to the original position.

Figure 4A:
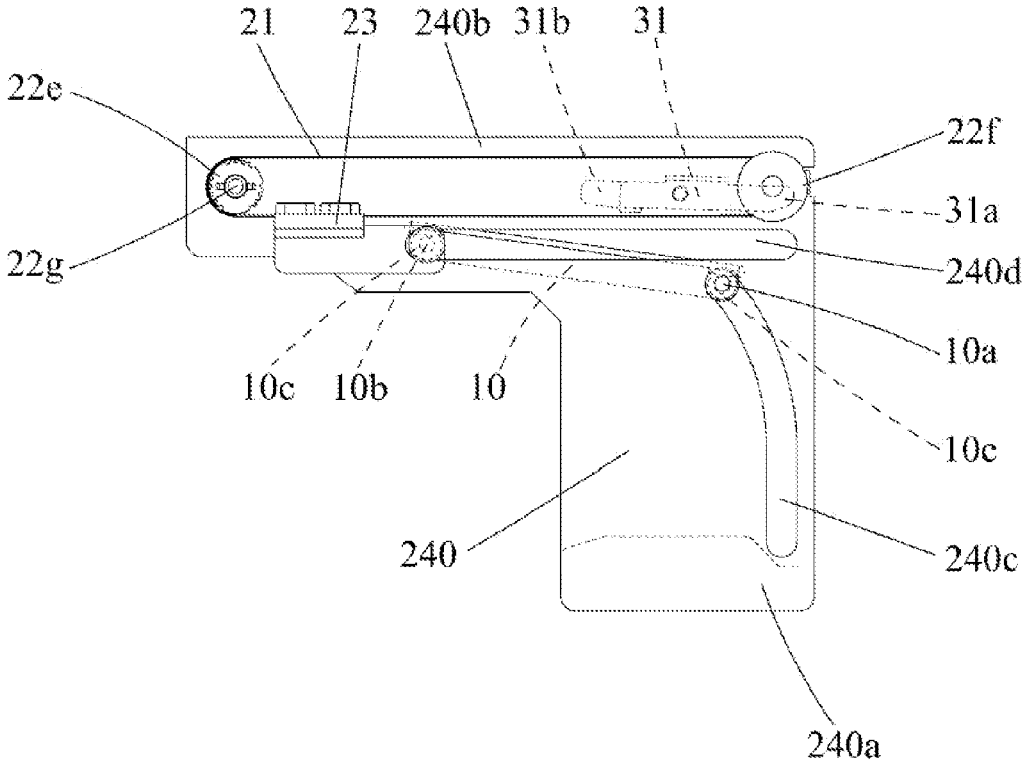
FIGS. 4*a* and 4*b* are schematic views of working states of the shutter mechanism of the present application.
Figure 4B:
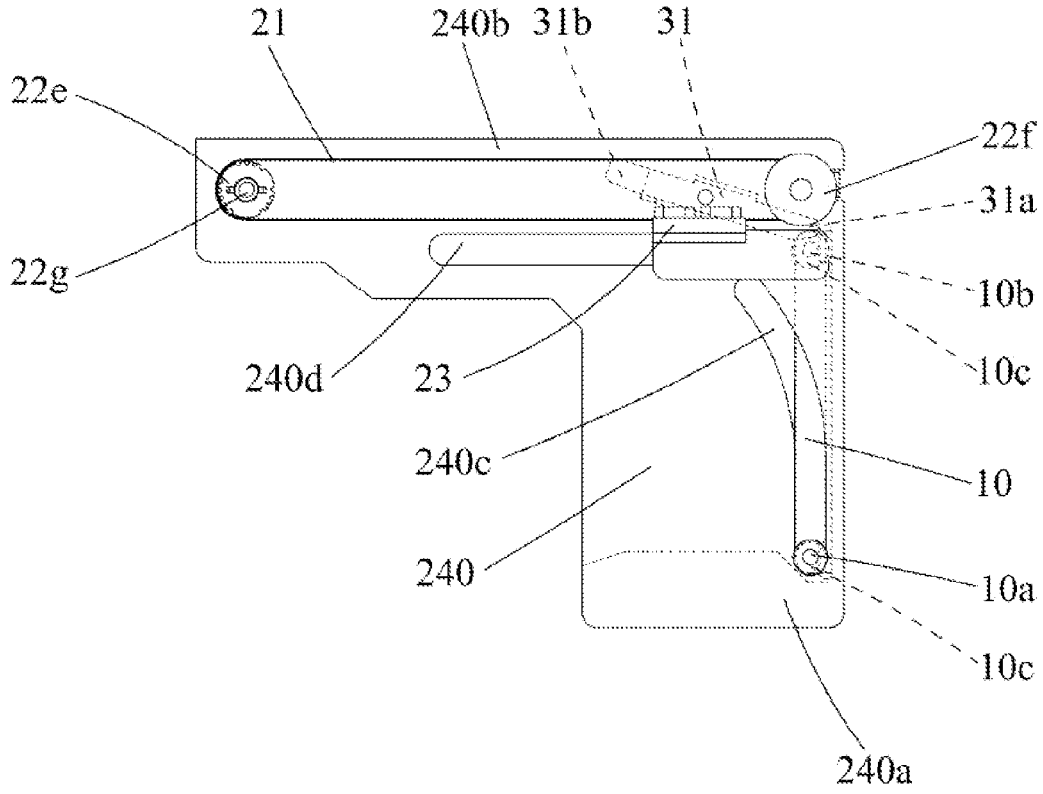
Figure 5:
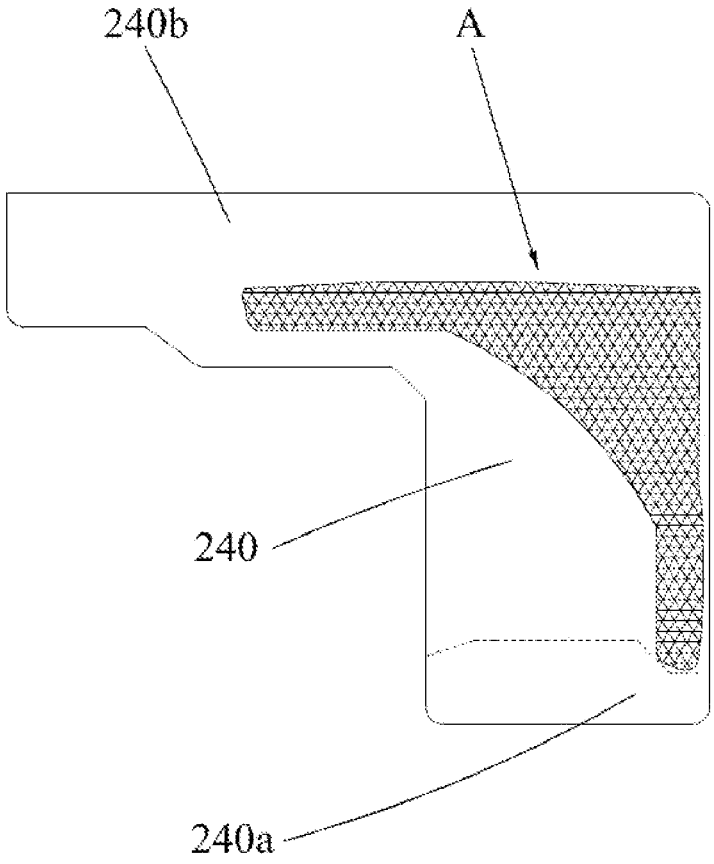
FIG. 5 is a structural schematic view of an enveloping space generated by the motion of a shutter of the shutter mechanism of the present application on a lateral surface of the frame.

When needs to close the banknote port 230*a* by the shutter 10, the controller sends a driving or controlling signal to the locking and driving assembly, then the locking and driving assembly drives the locking plate 31 to rotate around the rotating shaft 33 (i.e. in the anticlockwise direction in FIG. 2), such that the locking portion 31*a* of the locking plate 31 is lifted to avoid the enveloping space of the motion of the shutter 10. And at the same time, the sensing portion 31*b* of the locking plate 31 deviates from the detecting region of the first position sensor 32, then the first position sensor 32 sends an unblocked detecting signal to the controller to be analyzed and processed, such that the controller determines that the opening action of the locking plate 31 is completed. Then the controller sends a driving or controlling signal to drive the motor 22*a* to rotate in a reverse direction, the driving gear 22*b* engages with the driven gear 22*c* to transmit power to the torque limiter 22*h*, the driving shaft 22*d* is driven by the torque limiter 22*h* to rotate, then the primary driving wheel 22*e*, the auxiliary driving wheel 22*f* and the conveying belt 21 cooperate to transmit the power to the locking assembly 23 so as to drive the shutter 10, such that the second sliding portion 10*b* of the shutter 10 slides rightward along the second sliding groove 240*d* as shown in FIG. 4, meanwhile the first sliding portion 10*a* of the shutter 10 slides downward along the first sliding groove 240*c* as shown in FIG. 4, such that the shutter 10 can make a rigid planar motion combining the sliding and rotating motions. When one of the second position sensors 24, corresponding to a state that the shutter 110 is closed in place, detects that the detecting sheet 23*a* of the locking assembly 23 is in place, the shutter 10 is closed in place, corresponding to a state shown in FIG. 4*b*, and completes the action of closing the banknote port 230*a*. At this time, the controller sends a driving or controlling signal, the locking and driving assembly drives the locking plate 31 to rotate around the rotating shaft 33 to return to the original position, and when the locking plate 31 rotates back to a specific position, the sensing portion 31*b* blocks the detecting signal of the first position sensor 32, then the first position sensor 32 sends a blocked detecting signal to the controller to be analyzed, such that the controller determines that the locking plate 31 is returned to the original position, and at this time, the locking portion 31*a* of the locking plate 31 abuts against the upper end of the shutter 10 and locks the shutter 10. Wherein, when the second sliding portion 10*b* of the shutter 10 is sliding along the second sliding groove 240*d*, the first sliding portion 10*a* is sliding along the first sliding groove 240*c*, such that the shutter 10 forms the space region, formed by grid lines, indicated by an arrow A in FIG. 5. For preventing the first sliding portion 10*a* and the second sliding portion 10*b* of the shutter 10 from sliding out because of the first sliding portion 10*a* shaking inside the first sliding groove 240*c* and the second sliding portion 10*b* shaking inside the second sliding groove 240*d* front and back (i.e. in a direction perpendicular to the plane of FIG. 4*a*), a position-limiting structure (not shown) for avoiding the front-back shaking is provided on each of the first sliding portion 10*a* and the second sliding portion 10*b*, thereby ensuring that the front-back shaking will not occur when the shutter 10 slides along the first sliding groove 240*c* and the second sliding groove 240*d*. The second sliding portion 10*b* of the shutter 10 are fixedly connected to the conveying belt 21 via the locking assembly 23, which ensures that the position of the second sliding portions 10*b* of the shutter 10 relative to the locking assembly 23 is fixed in a left-right direction in FIG. 4*a* and the shutter 10 may rotate around the second sliding portion 10*b* relative to the locking assembly 23 in an up-down direction in FIG. 4*a*.

The lower end of the shutter 10 of the present application is slidably connected to the front end 240*a* of the lateral surface 240 of the frame in an up-down direction, the upper end of the shutter 10 is slidably connected to the upper end 240*b* of the lateral surface 240 of the frame in a front-back direction, and the upper end of the shutter 10 is driven by the driving mechanism 20 to slide along the upper end 240*b* of the lateral surface 240 of the frame front and back, and meanwhile the lower end of the shutter 10 is driven to move along the front end 240*a* of the lateral surface 240 of the frame up and down, such that the shutter 10 is driven by the driving mechanism 20 to make rigid planar motion (i.e. combining the existing sliding manner, sliding back and forth in a certain plane, and pivoting manner of the shutter), which overcomes the disadvantage of the existing sliding shutter mechanism or the pivoting shutter mechanism that the space occupied by the shutter mechanism is relatively large due to the extremely huge enveloping space generated by the motion of the shutter. Therefore, the shutter mechanism 100 of the present application can reduce the enveloping space generated by the motion of the shutter 10 and also reduce the space of the frame 210 occupied by the shutter 10, such that the structure of the shutter mechanism 100 of the present application is more compact.

The above disclosures are only several embodiments of the present application, and the protection scope of the present application is not limited to above embodiments; therefore, equivalent variations made based on the claims of the present application are also deemed to fall into the protection scope of the present application.

What is claimed is:

1. A shutter mechanism, being mounted on a lateral frame of a banknote port of a financial self-service device, comprising a shutter, a driving mechanism, and a locking mechanism for controlling the shutter, wherein a lower end of the shutter is slidably connected to a front end of a lateral surface of the frame in an up-down direction, an upper end of the shutter is slidably connected to an upper end of the lateral surface of the frame in a front-back direction, the upper end of the shutter is driven by the driving mechanism to slide along the upper end of the lateral surface of the frame front and back, which meanwhile drives the lower end of the shutter to move along the front end of the lateral surface of the frame up and down, thereby realizing the opening and closing of the shutter, wherein a first sliding groove is provided at the front end of the lateral surface of the frame in an up-down direction, a second sliding groove is provided at the upper end of the lateral surface of the frame in a front-back direction, a first sliding portion extending from the lower end of the shutter cooperates with the first sliding groove, and a second sliding portion extending from the upper end of the shutter cooperates with the second sliding groove, wherein the driving mechanism comprises a conveying member and a driving assembly, the conveying member is provided at the upper end of the lateral surface of the frame in a front-back direction, an output end of the driving assembly is connected to the conveying member, and the second sliding portion is fixed on the conveying member.

2. The shutter mechanism according to claim 1, wherein the first sliding groove comprises a straight portion and an arc portion, the arc portion is curved in a direction away from the banknote port and is provided adjacent to the second sliding groove, and the second sliding groove is a straight groove.

3. The shutter mechanism according to claim 1, wherein two first sliding portions are provided at two sides of the lower end of the shutter respectively, two second sliding portions are provided at two sides the upper end of the shutter respectively, the first sliding portions and the second sliding portions are cylindrical, and the cylindrical first sliding portions and second sliding portions each are pivotally connected with a roller wheel.

4. The shutter mechanism according to claim 1, wherein the driving mechanism further comprises a second position sensor electrically connected to a controller of the financial self-service device, and a locking assembly; the second sliding portion is fixed on one end of the locking assembly, the other end of the locking assembly is fixed on the conveying member, two second position sensors are respectively provided at the upper end of the lateral surface of the frame in a front-back direction and are located outside two sides of the locking assembly respectively; a position of the locking assembly corresponds to one of the second position sensors when the shutter closes the banknote port, and the position of the locking assembly corresponds to the other one of the second position sensors when the shutter opens the banknote port.

5. The shutter mechanism according to claim 4, wherein the driving assembly comprises a motor, a driving gear, a driven gear, a driving shaft, a primary driving wheel and an auxiliary driving wheel; the driving shaft is pivotally connected to a rear of the upper end of the lateral surface of the frame and protrudes out of the upper end of the lateral surface of the frame to form a mounting end, the primary driving wheel is mounted on the mounting end, the auxiliary driving wheel is pivotally connected to a front of the upper end of the lateral surface of the frame at a position corresponding to the primary driving wheel, the conveying member is surroundingly provided at outside of the primary driving wheel and the auxiliary driving wheel, the motor is mounted on the frame, the driving gear is mounted on an output shaft of the motor, the driven gear is mounted on the driving shaft and is engaged with the driving gear, and a torque limiter is provided between the driving shaft and the driven gear.

6. The shutter mechanism according to claim 1, wherein the locking mechanism comprises a locking and driving assembly electrically connected to a controller of the financial self-service device, and a locking plate located above the banknote port and pivotally connected to the frame; and the locking and driving assembly drives the locking plate to abut against and lock the shutter when the shutter closes the banknote port.

7. The shutter mechanism according to claim 6, wherein the locking mechanism further comprises a first position sensor electrically connected to the controller and provided at the upper end of the lateral surface of the frame; one end of the locking plate is extended toward the banknote port to form a locking portion, the other end of the locking plate is extended toward the first position sensor to form a sensing portion, and a position of the sensing portion corresponds to the first position sensor, when the shutter closes the banknote port and the locking portion abuts against and locks the shutter.

8. The shutter mechanism according to claim 7, wherein two locking portions are provided at two sides of the locking plate respectively.

* * * * *